US006876342B2

(12) United States Patent
Suzuki

(10) Patent No.: US 6,876,342 B2
(45) Date of Patent: Apr. 5, 2005

(54) PLASMA DISPLAY APPARATUS AND DRIVING METHOD THEREOF

(75) Inventor: Yoshio Suzuki, Kanagawa (JP)

(73) Assignee: Sony Corporation, Tokyo (JP)

( * ) Notice: Subject to any disclaimer, the term of this patent is extended or adjusted under 35 U.S.C. 154(b) by 263 days.

(21) Appl. No.: 10/225,988

(22) Filed: Aug. 22, 2002

(65) Prior Publication Data

US 2003/0038793 A1 Feb. 27, 2003

(30) Foreign Application Priority Data

Aug. 24, 2001 (JP) ..... 2001-254796
Jul. 18, 2002 (JP) ..... 2002-209704

(51) Int. Cl.[7] ..... G09G 3/28

(52) U.S. Cl. ..... 345/63; 345/67; 345/60; 345/690; 315/169.4

(58) Field of Search ..... 345/60–69, 690–692, 345/208–210, 204–205; 315/169.1, 169.4

(56) References Cited

U.S. PATENT DOCUMENTS 4,595,919 A * 6/1986 Holz et al. ..... 345/63
5,835,072 A * 11/1998 Kanazawa ..... 345/60
6,518,943 B1 * 2/2003 Masumura ..... 345/67
2003/0179162 A1 * 9/2003 Ooe et al. ..... 345/63

FOREIGN PATENT DOCUMENTS

JP 06-332397 * 12/1994 ..... G09G/3/20

* cited by examiner

*Primary Examiner*—Lun-Yi Lao
(74) *Attorney, Agent, or Firm*—Robert J. Depke; Holland & Knight LLP

(57) ABSTRACT

According to a plasma display apparatus of the present invention, at least in one sub-field, a driving signal applied to retain data written in each pixel has a frequency applied first and a frequency applied thereafter, the frequencies being different from each other. The first frequency is controlled to be low and the frequency thereafter is controlled to be high, for example (two-frequency driving method). With a first low-frequency pulse, initial discharge in a sustaining period is started stably, and with a high-frequency pulse thereafter, the discharge is sustained. Use of the high-frequency pulse increases the number of light emissions, thus leading to improvement in brightness. Thus, the present invention enables both discharge stabilization and increase in brightness, and can therefore improve picture quality of the plasma display apparatus.

5 Claims, 8 Drawing Sheets

PLASMA DISPLAY APPARATUS AND DRIVING METHOD THEREOF

This application claims priority to Japanese Patent Application Number JP2001-254796 filed Aug. 24, 2001, and Japanese Patent Application Number JP2002-209704 filed Jul. 18, 2002, each of which are incorporated herein by reference.

BACKGROUND OF THE INVENTION

The present invention relates to a plasma display apparatus and a driving method thereof. More particularly, the present invention relates to an improved technique of a sub-field method for gradation display.

Plasma display panels (PDP) are known as image display apparatus to replace currently predominant cathode-ray tubes (CRTs). The plasma display apparatus has advantages of making it relatively easy to increase screen size and widen a viewing angle, having excellent resistance to environmental factors such as the temperature, magnetism, vibration and the like, having a long life, and the like. The plasma display apparatus is expected to be applied to wall-hung televisions for household use and to large information terminal apparatus for public use.

The plasma display apparatus applies a voltage to a discharge cell in which a discharge gas such as an inert gas is sealed in a discharge space, excites a phosphor layer within the discharge cell with vacuum ultraviolet rays generated from glow discharge in the discharge gas, and thereby obtains light emission. Thus, each individual discharge cell is driven on principles similar to those of a phosphor light. A large number of discharge cells are brought together to form pixels, whereby one display screen is formed. Each discharge cell is driven to be turned on or off, and thus produces two-gradation-step display in principle.

Plasma display apparatus are roughly classified into a direct-current driving type (DC type) and an alternating-current driving type (AC type) according to the method of applying a voltage to a discharge cell. The AC type plasma display apparatus is suitable for higher resolution because it suffices to form in a stripe manner barrier ribs serving to divide individual discharge cells within the display screen. In addition, since the surfaces of discharge electrodes are covered with a dielectric layer, the electrodes resist wear. The AC type plasma display apparatus therefore has an advantage of having a long life.

A sub-field method is known to realize multiple-gradation-step display on a plasma display apparatus that displays a screen by driving individual discharge cells on or off. In order to write and retain in a pixel multiple-gradation-step data formed by a plurality of weighted bits, the sub-field method divides one field into a plurality of sub-fields corresponding to the plurality of bits.

Each of the bits is written in the corresponding sub-field, and a driving signal corresponding to the weight of the bit is applied to the discharge cell to retain the bit. In other words, for a number of light emissions corresponding to the weight of each bit place of N-bit pixel data, the sub-field method divides the display period of one field into N sub-fields. The sub-field method thus produces display.

In a case of 8-bit pixel data, for example, the display period of one field is divided into eight sub-fields. In this case, the numbers of discharge light emissions of the sub-fields are set at for example 1, 2, 4, 8, 16, . . . , and 128, respectively, and 256-gradation-level display is produced by a combination of the eight sub-fields.

The number of discharge light emissions corresponds to the number of pulses included in the driving signal. Pulse frequency of the driving signal applied in each of the sub-fields is generally constant. A sub-field corresponding to a more significant bit has a large number of light emissions, and therefore has a long sub-field period.

On the other hand, a sub-field corresponding to a less significant bit has a small number of light emissions, and therefore has a small sub-field time width. In gradation display, in order to maintain brightness of the screen, all the sub-fields are set so as to be included in one field. With such setting, the less significant the bit, the smaller the time width of the sub-field.

In the case of a least significant bit, in particular, an effective time width included in the sub-field period is extremely short, and therefore it is difficult to produce a stable display.

There is a desire to increase the number of gradation steps for higher picture quality. When the number of gradation steps is thus increased, the number of sub-fields is also increased according to the number of gradation steps. Light emission sustaining periods of sub-fields corresponding to the less significant bit side are correspondingly shortened. There is also a desire to increase the number of scanning lines for higher picture quality.

When resolution is thus increased, the light emission sustaining periods on the less significant bit side are squeezed and shortened. In order to deal with such a problem, the pulse frequency of the driving signal tends to be raised so that sufficient brightness can be obtained even when picture quality is thus improved. However, simply raising the pulse frequency of the driving signal results in susceptibility to unstable operation, screen flicker, and inability to display correct gradation levels.

SUMMARY OF THE INVENTION

It is an object of the present invention to stabilize the operation of a plasma display apparatus and thereby improve brightness and picture quality. According to a first aspect of the present invention, there is provided a plasma display apparatus including: a panel including a dischargeable gas sealed between a pair of substrates joined to each other, a first electrode and a second electrode formed on one substrate in correspondence with each scanning line, and a third electrode formed on the other substrate in correspondence with each data line; and a driving unit for driving the first electrode, the second electrode, and the third electrode, sequentially writing and retaining data at an intersection of each scanning line and each data line, and thereby displaying one field of image.

The driving unit includes input means, coding means, timing means, addressing means, and sustaining means.

The input means inputs multiple-gradation-step data obtained by quantizing a signal representing an image. The coding means codes one field of the quantized data by a predetermined rule to thereby convert into data distributed over a plurality of sub-fields (and given a weight for each of the sub-fields). The timing means sequentially outputs a timing signal for each of the sub-fields in synchronism with the coding.

The addressing means scans scanning lines in each of the sub-fields in response to the timing signal while writing data assigned to the sub-field via data lines.

The sustaining means includes frequency control means, applies a driving signal to the first electrode and the second electrode according to the weight of each of the sub-fields, and thereby retains the data written by the addressing means, the driving signal applied to retain the data having, at least in one sub-field, a frequency applied first and a frequency applied thereafter, the frequencies being different from each other.

According to the first aspect of the present invention, at least in one sub-field, the driving signal applied to retain the data written in each pixel has a frequency applied first and a frequency applied thereafter, the frequencies being different from each other.

The first frequency is controlled to be low and the frequency thereafter is controlled to be high, for example. With a first low-frequency pulse, initial discharge in a sustaining period is started stably, and with a high-frequency pulse thereafter, the discharge is sustained. Use of the high-frequency pulse increases the number of light emissions, thus leading to improvement in brightness. Since the low-frequency pulse is used in a first part of the sustaining period, the sustained discharge itself can be started stably. It is to be noted that more than two frequencies may be applied.

Thus, the present invention makes it possible to achieve both discharge stabilization and increase in brightness, and therefore the present invention can contribute to improvement in picture quality of the plasma display apparatus. Incidentally, in the present specification, the above method may be referred to as a two-frequency driving method.

In addition, according to a second aspect of the present invention, the driving unit includes input means, coding means, timing means, addressing means, and sustaining means. The input means inputs multiple-gradation-step data obtained by quantizing a signal representing an image. The coding means codes one field of the quantized data by a predetermined rule to thereby convert into data distributed over a plurality of sub-fields (and given a weight for each of the sub-fields). The timing means sequentially outputs a timing signal for each of the sub-fields in synchronism with the coding. The addressing means scans scanning lines in each of the sub-fields in response to the timing signal while writing data assigned to the sub-field via data lines.

The sustaining means includes voltage control means, applies a driving signal to the first electrode and the second electrode according to the weight of each of the sub-fields, and thereby retains the data written by the addressing means, the driving signal applied to retain the data having, at least in one sub-field, a voltage applied first and a voltage applied thereafter, the voltages being different from each other.

According to the second aspect of the present invention, at least in one sub-field, the driving signal applied to retain the data written in each pixel has a voltage applied first and a voltage applied thereafter, the voltages being different from each other.

The first voltage is controlled to be high and the voltage thereafter is controlled to be low, for example. By thus setting the voltage level of the driving signal in two steps, a voltage margin of the driving signal required for stable operation can be increased.

It is thereby possible to perform stable operation. It is to be noted that the voltage level of the applied signal may be set in more than two steps. In addition, even when the pulse frequency of the driving signal is raised to increase brightness, it is possible to perform driving without flicker. After sustained discharge is started stably at the first high voltage level, the voltage level of subsequent pulses can be lowered, thus leading to low radiation and low power consumption.

DETAILED DESCRIPTION OF THE PREFERRED EMBODIMENTS

Figure 1:
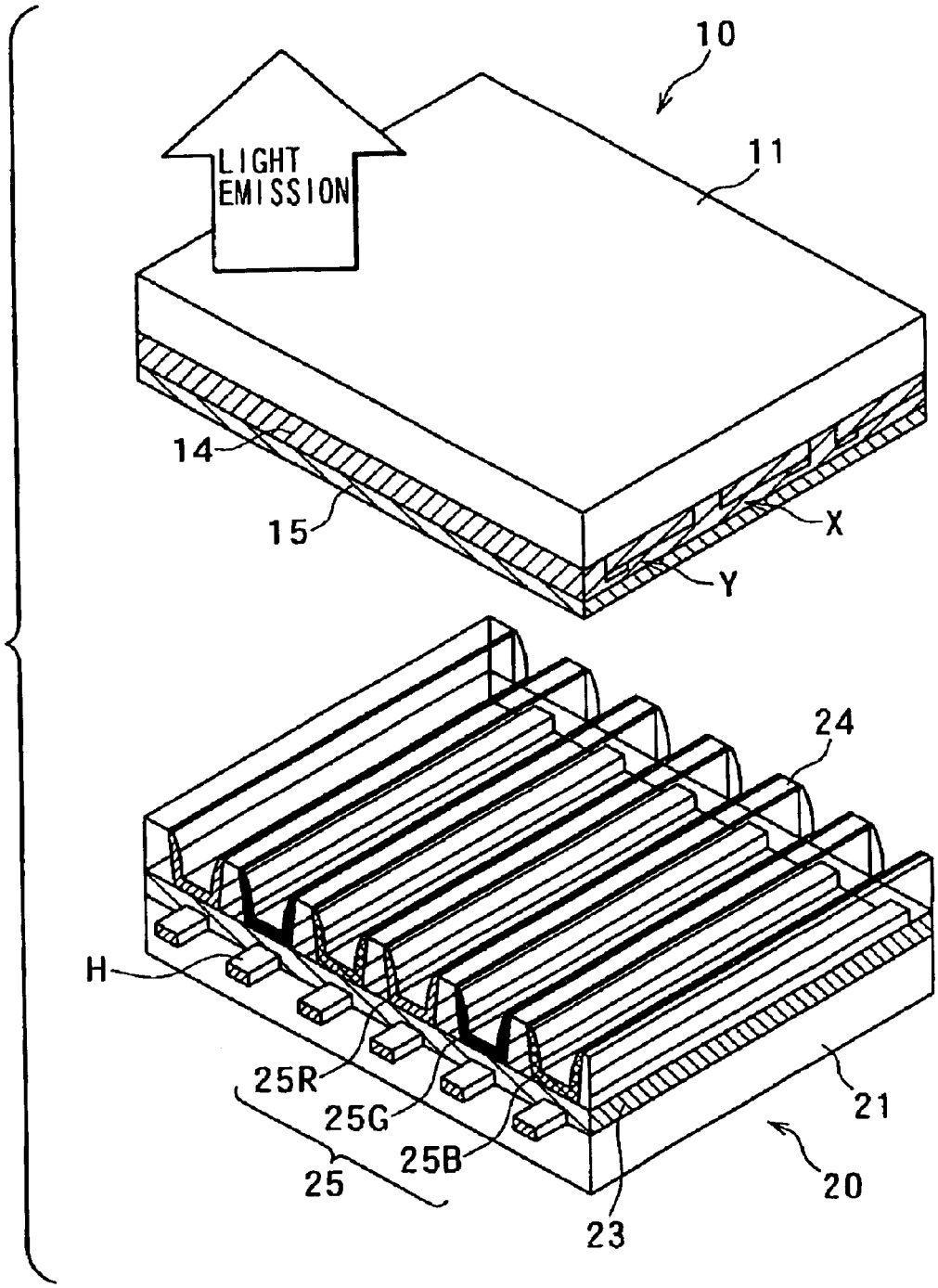
FIG. 1 is an exploded perspective view of structure of a plasma display apparatus according to the present invention.

Preferred embodiments of the present invention will hereinafter be described in detail with reference to the drawings. As shown in FIG. 1, a plasma display apparatus according to the present invention is of an AC type and of a three-electrode type. The plasma display apparatus is formed with a front panel 10 and a rear panel 20 joined to each other at peripheral portions thereof. Light emission of a phosphor layer 25 on the rear panel 20 is observed through the front panel 10.

The front panel 10 includes: a transparent glass substrate 11; a plurality of pairs of scanning electrodes Y and sustaining electrodes X formed of transparent conductive material and disposed in a stripe manner on the glass substrate 11; a dielectric layer 14 of dielectric material formed on the glass substrate 11 so as to cover the electrodes; and a protective film 15 of MgO or the like formed on the dielectric layer 14.

Bus electrodes of a metallic material having a low electric resistivity are formed on the scanning electrodes Y of the transparent conductive material to lower impedance of the scanning electrodes Y. Similarly, bus electrodes of a metallic material having a narrow width are formed on the sustaining electrodes X of the transparent conductive material.

A gap between a scanning electrode Y and a sustaining electrode X is 10 to 100 $\mu$m. A pair of a scanning electrode Y and a sustaining electrode X has an arrangement pitch of 600 to 1200 $\mu$m.

The rear panel 20 includes: a glass substrate 21; a plurality of data electrodes H disposed in a stripe manner on the glass substrate 21; a dielectric material layer 23 formed on the glass substrate 21 including the data electrodes H; insulative barrier ribs 24 on the dielectric material layer 23, the barrier ribs extending in regions between adjacent data electrodes H in parallel with the data electrodes H; and a phosphor layer 25 disposed extending from portions over the dielectric material layer 23 up to portions over side wall surfaces of the barrier ribs 24.

In a case where the AC type plasma display apparatus produces a color display, the phosphor layer 25 is formed of a red phosphor layer 25R, a green phosphor layer 25G, and a blue phosphor layer 25B. The red phosphor layer 25R, the green phosphor layer 25G, and the blue phosphor layer 25B are disposed in predetermined order.

FIG. 1 is an exploded perspective view, and therefore top portions of the barrier ribs 24 on the rear panel 20 side are in practice in contact with the protective film 15 on the front panel 10 side. An area where a pair of a scanning electrode Y and a sustaining electrode X overlaps a data electrode H situated between two barrier ribs 24 corresponds to a discharge cell.

The inside of the discharge space enclosed by the adjacent barrier ribs 24, the phosphor layer 25, and the protective film 15 is filled with a discharge gas such as an ionizable rare gas or the like. The front panel 10 and the rear panel 20 are joined to each other at the peripheral portions thereof by using a frit glass. The barrier ribs 24 have a height of 50 to 200 $\mu$m. A groove sandwiched between adjacent barrier ribs 24 has a width of 100 to 400 $\mu$m.

A row direction in which a projection of the scanning electrodes Y and the sustaining electrodes X extends is perpendicular to a column direction in which a projection of the data electrodes H extends. An area where a pair of a scanning electrode Y and a sustaining electrode X perpendicularly intersects a set of phosphor layers 25R, 25G, and 25B emitting light of three primary colors corresponds to one pixel. Because a glow discharge occurs between a pair of a scanning electrode Y and a sustaining electrode X, the AC plasma display apparatus of this type is referred to as a "surface discharge type."

The plasma display apparatus of the surface discharge type has a dischargeable gas enclosed between the pair of substrates 11 and 21 joined to each other as described above, and has a three-electrode structure with electrodes formed on each of the substrates.

Specifically, a scanning electrode Y and a sustaining electrode X, or a first electrode and a second electrode corresponding to each scanning line extending in the row direction are formed on one substrate 11, while a data electrode H, or a third electrode corresponding to each data line extending in the column direction is formed on the other substrate 21. A dot is formed at an intersection of each scanning line and each data line, and a set of three RGB dots forms one pixel.

In general, a gas sealed in the discharge space formed between the pair of glass substrates 11 and 21 is formed by mixing an inert gas such as neon, helium, argon or the like with about 4% xenon gas, for example. A total pressure of the mixed gas is about $6\times10^4$ Pa to $7\times10^4$ Pa, and a partial pressure of the xenon is about $3\times10^3$ Pa, for example.

Figure 2:
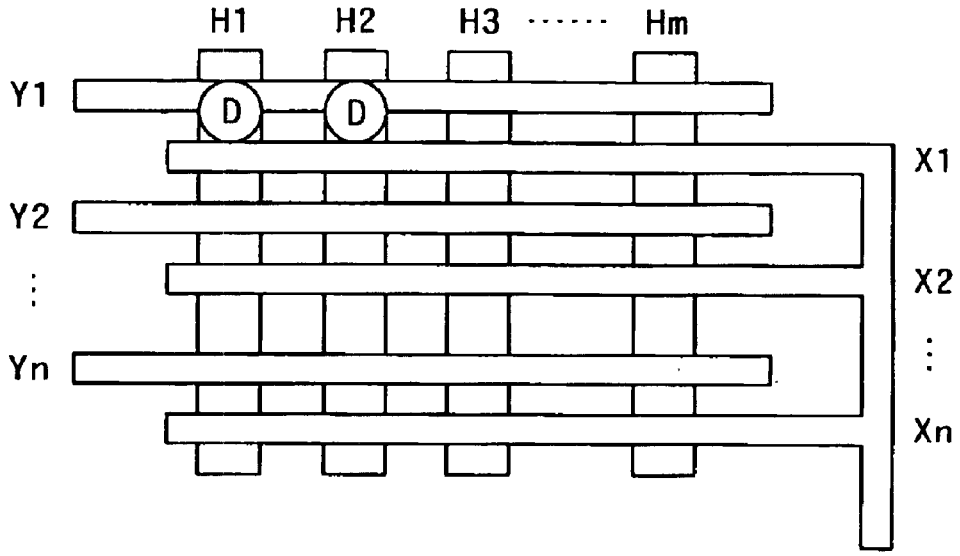
FIG. 2 is a schematic diagram showing an electrode configuration of the plasma display apparatus according to the present invention.

FIG. 2 schematically shows the three-electrode structure of the plasma display apparatus. In correspondence with scanning lines along the row direction (horizontal direction), n scanning electrodes Y1 to Yn are formed. In this case, n denotes the number of scanning lines. Sustaining electrodes X1 to Xn are formed in parallel with the scanning electrodes Y1 to Yn.

On the other hand, m data electrodes H1 to Hm are formed along data lines in the column direction (vertical direction). In this case, m denotes the number of data lines. A dot D is formed at an intersection of each of the m data lines and each of the n scanning lines.

Application of driving signals to the scanning electrode Y, the sustaining electrode X, and the data electrode H in a predetermined sequence causes plasma discharge. The phosphor material is thereby irradiated with resulting ultraviolet radiation to emit light and thus enable display of an image.

Figure 3:
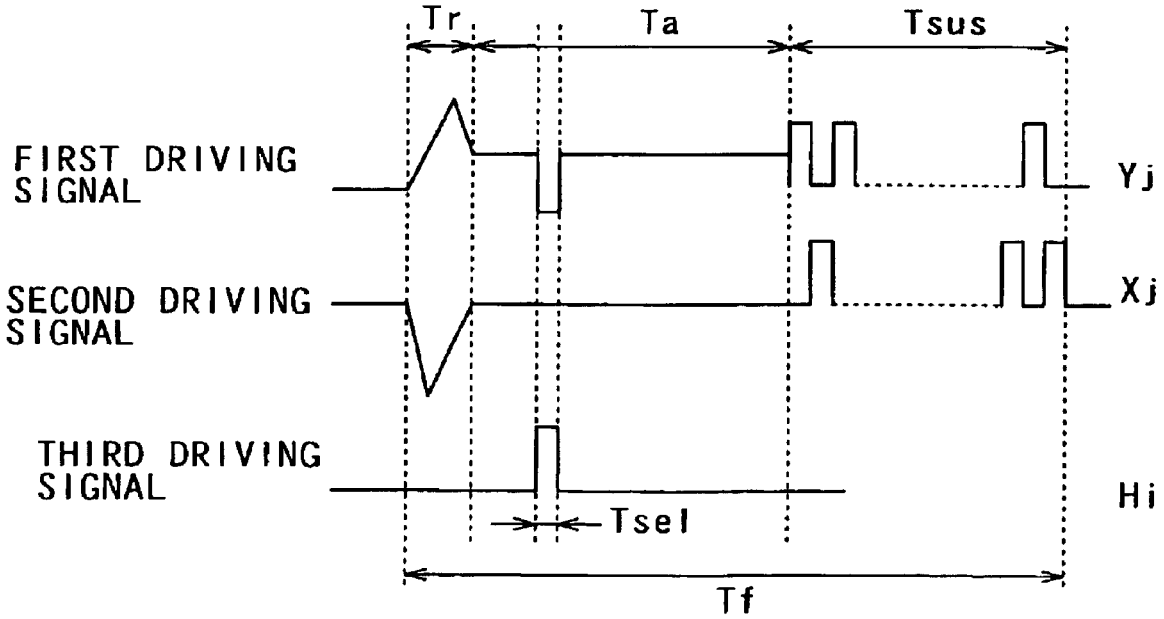
FIG. 3 is a timing chart of a basic driving method of the plasma display apparatus.

FIG. 3 is a timing chart showing driving waveforms when attention is directed to a dot D situated at an ith column and a jth row. A driving circuit (not shown) connected to the panel shown in FIG. 2 applies a first driving signal to a scanning electrode Yj, applies a second driving signal to a sustaining electrode Xj, and applies a third driving signal to a data electrode Hi. In the example of FIG. 3, two-gradation-step display is performed using the whole of one field period Tf.

The field period Tf is divided into a resetting period Tr, an addressing period Ta, and a sustaining period Tsus. First, in the resetting period Tr, before data is written to each dot, charge within the panel is discharged to reset the whole screen to a uniform state.

Alternatively, the whole screen may be reset to a uniform state by charging the inside of the panel with electric charges. For this purpose, driving signals are applied to all of the scanning electrodes Y and the sustaining electrodes X in the resetting period Tr. Incidentally, the scanning electrodes Y are electrically separated from each other, whereas the sustaining electrodes X are all connected to a common point.

In the next addressing period Ta, line-sequential scanning is performed for all of the scanning lines to select each of the scanning lines. In order to select a scanning line of the jth row, a first driving signal in the form of a pulse is applied to the scanning electrode Yj. A period when one scanning line is selected is denoted by Tsel. Tsel is equal to pulse width of the first driving signal. At this time, in synchronism with the line-sequential scanning of the scanning line, the third driving signal is supplied to the data electrode H.

For example, when data of 1 is to be written to the dot at the jth row and the ith column, the third driving signal as shown in FIG. 3 is applied as a pulse to the data electrode Hi. On the other hand, when data of 0 is to be written to the dot at the jth row and the ith column, no pulse is applied.

Thus, the addressing period Ta is a period when the scanning lines are addressed and selected. The selection is repeated by the number of scanning lines of the display, and the third driving signal corresponding to binary information 0 or 1 of the image is applied to the data electrode H in synchronism with the selection. The addressing period Ta=Tsel×n.

The driving signal of ON=1 or OFF=0 is applied to the data electrode Hi in correspondence with the display dot Dji, and the first driving signal is applied to the scanning electrode Yj in correspondence with the position of the dot Dji. After completion of line-sequential scanning for one screen in the column direction (vertical direction), the driving operation enters the sustaining period Tsus.

In the sustaining period Tsus, light emitting/non-emitting operation is performed according to a state of ON/OFF written in the addressing period Ta. When ON=1 has been written in the addressing period Ta, light emission is sustained to obtain a desired brightness.

On the other hand, when OFF=0 has been written in the addressing period, the non-emitting state is sustained. In the sustaining period Tsus, a driving signal in the form of a pulse is applied between the scanning electrode Y and the sustaining electrode X, so that light emission is repeated in response to the pulse. As described above, the plasma display apparatus basically performs ON/OFF driving of a dot, and hence produces a two-gradation-step display.

Figure 4:
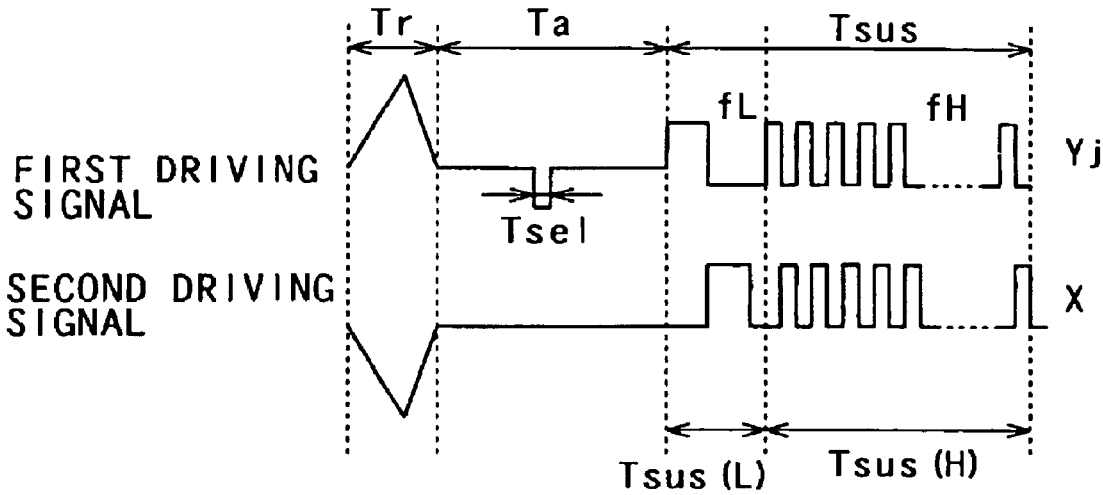
FIG. 4 is a timing chart of an embodiment of a driving method of the plasma display apparatus according to the present invention.

FIG. 4 is a timing chart of principles of a two-frequency driving method according to the present invention. As shown in FIG. 4, the two-frequency driving method divides a sustaining period Tsus into at least two parts: a first part Tsus (L) and a second part Tsus (H).

The first part Tsus (L) has a low pulse frequency fL necessary for stable discharge, and the second part Tsus (H) has a high pulse frequency fH necessary for maintaining a brightness. Thus, in the present invention, when data written as a charge in an addressing period Ta is retained in the sustaining period Tsus, a driving signal of the relatively low pulse frequency fL is applied in the first period Tsus (L) for sustained discharge, so that the sustained discharge can be started stably.

Thereafter, a driving signal of the relatively high pulse frequency fH is applied in the second period Tsus (H) to thereby sustain the discharge. The high pulse frequency increases the number of light emissions, and thus can correspondingly improve brightness.

The above driving method makes it possible to achieve both stable discharge and improvement in brightness, and can therefore contribute to improvement in image quality. The above driving method is effective especially when applied to a sub-field method. In the sub-field method, sustaining periods Tsus on the side of less significant bits are squeezed, thus making it difficult to maintain stable discharge and luminous brightness.

Even in such a case, the two-frequency driving method explained with reference to FIG. 4 makes it possible to achieve both discharge stabilization and increase in brightness at the same time. In this example, the frequency is set in two steps; however, since a large difference between the two frequencies is known to reduce the above effects, the frequency may be changed in three steps.

Figure 5:
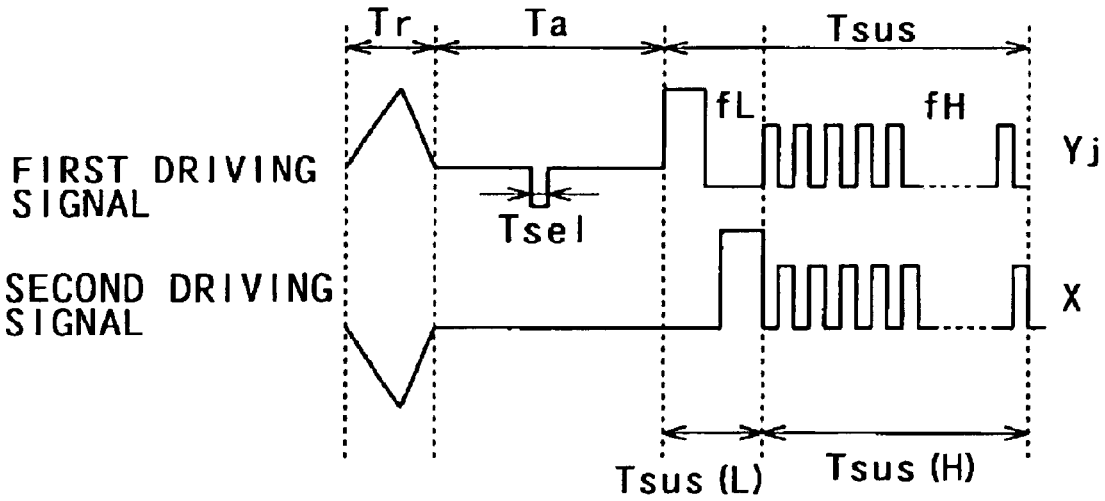
FIG. 5 is a timing chart of another embodiment of the driving method of the plasma display apparatus according to the present invention.

FIG. 5 is a timing chart of another embodiment of the driving method according to the present invention. In the present embodiment, a driving signal at a high voltage level is used in a first part Tsus (L) of a sustaining period Tsus, and a driving signal at a low voltage level is used in a second part Tsus (H) of the sustaining period Tsus. Thus, the voltage level of the driving signals for sustaining discharge is optimized in the first part and the second part of the sustaining period Tsus to thereby stabilize the operation.

As described above, the plasma display apparatus performs a resetting discharge in a resetting period Tr to accumulate a wall charge in all dots. In a next addressing period Ta, each of the dots is made to retain or eliminate the wall charge, whereby data is written.

In the subsequent sustaining period, each of the dots emits light or emits no light depending on a state of the wall charge, thus producing ON/OFF display. This ON/OFF selection is made on the basis of whether the wall charge is present or not. Conventionally, the voltage of the driving signals applied in the sustaining period is fixed at one level.

Therefore, a voltage margin with respect to the wall charge needs to be set large. Also, when the pulse frequency of the driving signals is raised to increase brightness, a margin of voltage level for making ON/OFF selection correctly is reduced.

Accordingly, the present embodiment sets the voltage of pulses in a first few cycles larger than that of subsequent pulses to facilitate lighting of the dot. Setting for the ON time is made such that a total of the first pulse voltage and the wall charge can light the dot.

During the ON time, once the dot is lit, only a low sustaining voltage is required, so that the lit state of the dot can be maintained even when the driving signal is changed to a low voltage level. On the other hand, setting for the OFF time is made such that with no wall charge, the pulse voltage in the first few cycles does not light the dot. Therefore, the dot is not lit in this case. Since the subsequent pulses are further decreased in voltage, the OFF state can be maintained.

Thus, setting the pulse level during the sustaining period in two steps makes it possible to increase the voltage margin. This results in stabilization of the operation of the plasma display apparatus. In addition, driving free from flicker is possible even when the pulse frequency of the driving signals is raised to increase brightness. Furthermore, since the sustaining voltage can be lowered, effects of low power consumption and low radiation can be expected.

The driving methods illustrated in FIG. 4 and FIG. 5 are suitably applied particularly to a driving sequence of each sub-field when the plasma display apparatus produces multiple-gradation-step display. An embodiment of multiple-gradation-step display by the sub-field method will be described with reference to FIG. 6. In the case of two-gradation-step display, data written in each dot is formed by a single bit 0 or 1.

In the case of multiple-gradation-step display, on the other hand, multi-bit data formed by a plurality of bits that are given weights decreasing in steps from a most significant digit toward a least significant digit is written to each dot. In the sub-field method, one field period Tf is divided into a plurality of sub-fields corresponding to the plurality of bits.

In the example shown in FIG. 5, the multiple-gradation-step data is eight-gradation-step data from a most significant bit B7 to a least significant bit B0, and the field period Tf is divided into eight sub-field periods T7, T6, T5, . . . , and T0.

Each of the bits is written in the corresponding sub-field, and a driving signal having a number of pulses corresponding to the weight of the bit is applied between the scanning electrode and the sustaining electrode to retain the bit during the sustaining period. In the example shown in FIG. 5, the most significant bit B7 is written and retained in the sub-field period T7; the next bit B6 is written in the next sub-field period T6; and thereafter the remaining bits down to the least significant bit B0 are sequentially written within the field period Tf.

According to the present invention, the driving sequence shown in FIG. 4 or FIG. 5 is performed in each sub-field to write a corresponding bit. When attention is directed to the first sub-field T7, for example, the whole of the screen is reset in a resetting period Tr, the most significant bit B7 is written in an addressing period Ta, and the written bit data B7 is retained in a sustaining period Tsus. A dot in which B7=1 is written repeats pulse light emission, whereas a dot in which B7=0 is written remains in a non-emitting state.

A similar sub-field driving sequence is repeated in each of the following periods T6, T5, . . . , and T0. In the sub-field periods T, length of time of the period Tr+Ta that does not contribute to real brightness is the same, but the effective period Tsus that contributes to the brightness differs.

Specifically, a driving signal having a number of pulses according to the weight of the bit is applied in each sub-field. The most pulses are applied for the most significant bit; half the number of pulses are applied for the next bit B6; and thereafter the number of pulses is halved for each of the following bits.

In this example, a driving signal having a fixed pulse frequency is applied between the scanning electrode and the sustaining electrode in all of the sub-field periods. The sustaining period Tsus simply has a time length corresponding to the weight of the corresponding bit. Hence, the sub-field period T, which is a sum of Tr, Ta, and Tsus, is shortened from T7 to T0, for example, as shifted from the most significant bit to the least significant bit.

Figure 6:
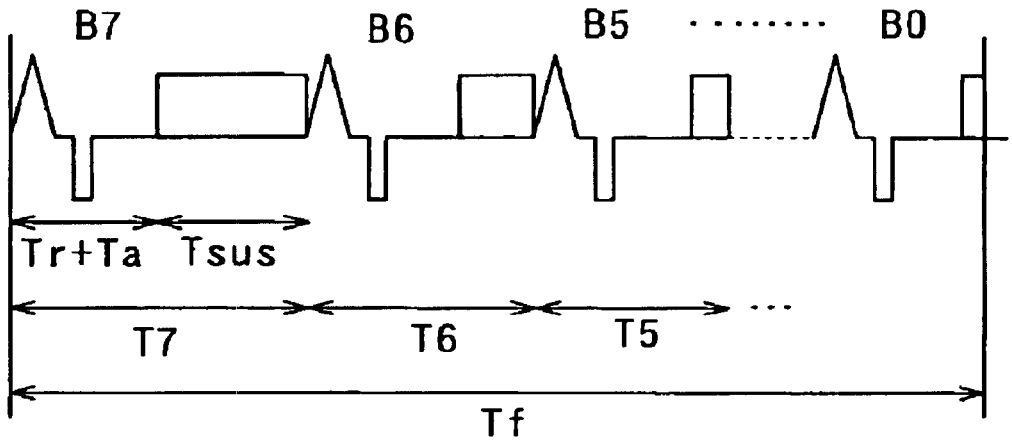
FIG. 6 is a timing chart of an example of a sub-field method according to the present invention.

In the example shown in FIG. 6, when the number of gradation steps is 256 represented by 8 bits, for example, the driving sequence shown in FIG. 4 or FIG. 5 is repeated as a sub-field eight times within the actual field period Tf, and light is emitted for the weighted sustaining periods Tsus.

Luminous brightness per pulse is constant. By extending length of time of the sustaining period according to the weight in each sub-field, the effects are visually integrated over one field period Tf, and are thereby perceived as a brightness level.

Two-frequency driving as shown in FIG. 4, for example, is performed in the sustaining period of each sub-field. Pulses of a low frequency fL are applied in a first part of the sustaining period Tsus, and pulses of a high frequency fH are applied in a second part of the sustaining period Tsus. The pulse frequencies fL and fH are the same in all of the sub-field periods.

Figure 7:
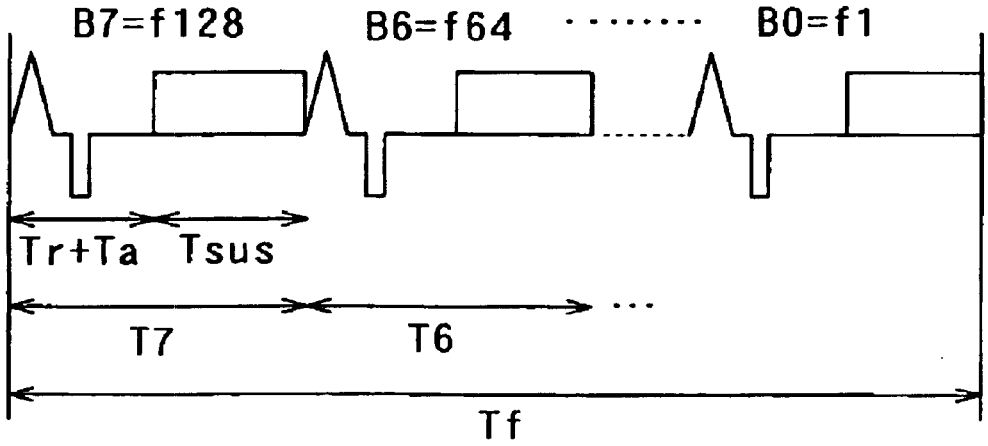
FIG. 7 is a timing chart of another example of the sub-field method according to the present invention.

FIG. 7 is a timing chart showing another embodiment of the sub-field method of the plasma display apparatus according to the present invention. The plasma display apparatus basically has a display characteristic of changing brightness according to the number of pulses applied during the sustaining period. Directing attention to this characteristic, the present embodiment changes the brightness by the number of pulses rather than by changing time width.

Control of time width of the sustaining periods Tsus according to the weights as in the foregoing example shown in FIG. 6 is not necessarily required. In the example shown in the timing chart of FIG. 7, sub-field periods T7, T6, . . . , and T0 are equal to each other, and sustaining periods Tsus directly contributing to brightness in the sub-field periods are also equal to each other, while a number of pulses corresponding to the weight of the bit is assigned to each of the sustaining periods Tsus. In other words, the pulse frequency is varied in each of the sub-fields.

When the sustaining periods Tsus are all at equal intervals in the field period Tf in the example of FIG. 7, as contrasted with the time width control shown in FIG. 6, the time length of each of the sustaining periods Tsus corresponds to a time length assigned to a bit B5. The number of pulses assigned to each of the sustaining periods Tsus corresponds to the gradation weight. Letting f1 be the pulse frequency of a least significant bit B0, a driving signal having a pulse frequency f2=2×f1 is applied for a bit B1; a driving signal having a pulse frequency f4=4×f1 is applied for a bit B4; and a driving signal having a pulse frequency f128=128×f1 is applied for a most significant bit B7.

In this case, the number of pulses per unit time and brightness are in a linear relation to each other; however, even when the number of pulses per unit time and the brightness are in a nonlinear relation to each other, it suffices to adjust the relation to the light emission characteristics, thus presenting no particular problem. This new method allows length of the sustaining period Tsus even in a sub-field corresponding to the least significant bit LSB to be set equal to that of a more significant bit.

Also in the variable pulse frequency method illustrated in FIG. 7, the two-frequency driving shown in FIG. 4 can be performed in the sustaining period of each of the sub-fields. In that case, the low frequency fL of a pulse applied in a first part of the sustaining period would be lower than that of the later part of sustaining pulses. The low frequency fL does not care to vary in every sub-fields.

The high frequency fH of driving pulses is variably controlled in a second part of the sustaining period, which part occupies most of the sustaining period, according to the weight of each of the sub-fields. In this case, driving pulse frequencies required are: fL used commonly in each of the sub-fields; and a total of eight frequencies F128, F64, . . . , and F1 used separately in the individual sub-fields.

Incidentally, the low frequency fL may also be set to an optimum frequency in each of the sub-fields. In this case, the driving is performed with a total of 16 frequencies.

As described above, either the fixed pulse frequency method illustrated in FIG. 6 or the variable pulse frequency method illustrated in FIG. 7 can be used as a multiple-gradation-step display method. In either case, to improve image quality (to increase brightness, resolution, and gradation steps) means a lower ratio of the sustaining period to the field period. In order to deal with this, as many pulses as possible need to be inserted in the sustaining period.

However, in the case of the ordinary method illustrated in FIG. 3, simply raising the pulse frequency within the sustaining period Tsus results in screen flicker and unstable discharge. Thus, according to the present invention, as shown in FIG. 4, the sustaining period Tsus is divided into at least two parts so that the first part Tsus (L) has a low frequency fL necessary for stable discharge and the second part Tsus (H) has a high frequency fH necessary for maintaining a brightness.

Figure 8:
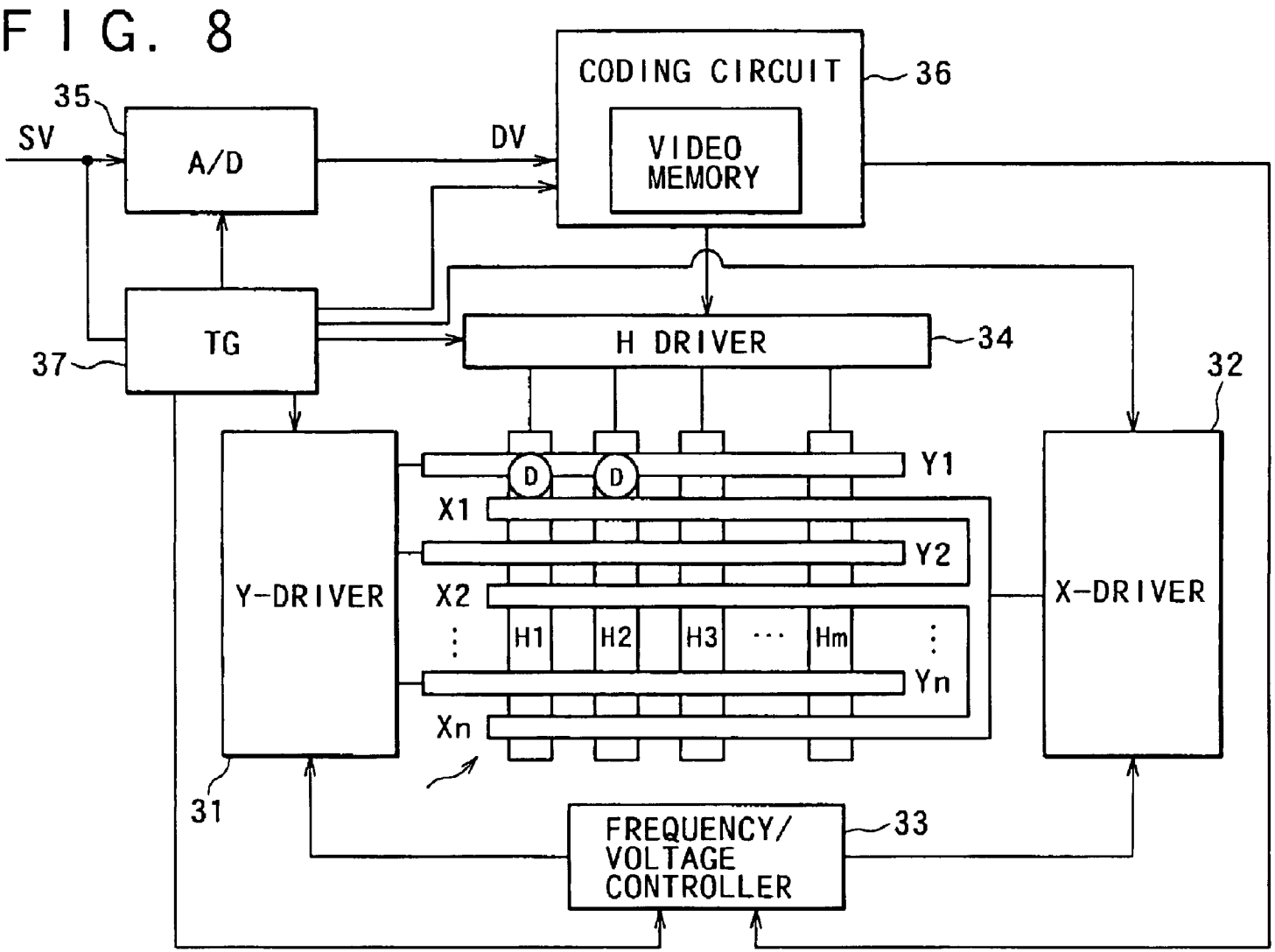
FIG. 8 is a schematic block diagram showing a specific configuration of a driving unit of the plasma display apparatus according to the present invention.

FIG. 8 is a block diagram showing a specific embodiment of a plasma display apparatus using the driving methods according to the present invention. As shown in FIG. 8, the plasma display apparatus includes a panel forming a main unit of the plasma display apparatus and a peripheral driving unit. The panel is formed as shown in FIG. 1 and FIG. 2.

Specifically, in correspondence with scanning lines along a row direction (horizontal direction), n scanning electrodes Y1 to Yn are formed. In this case, n denotes the number of scanning lines. Sustaining electrodes X1 to Xn are formed in parallel with the scanning electrodes Y1 to Yn.

On the other hand, m data electrodes H1 to Hm are formed along data lines in a column direction (vertical direction). In this case, m denotes the number of data lines. A dot D (pixel) is formed at an intersection of each of the m data lines and each of the n scanning lines. Application of driving signals to the scanning electrode Y, the sustaining electrode X, and the data electrode H in a predetermined sequence causes plasma discharge. The phosphor material is thereby irradiated with resulting ultraviolet radiation to thus enable display of an image.

In order to drive the panel having such a configuration, the peripheral driving unit is connected to the panel. The driving unit includes a Y driver 31, an X driver 32, a frequency/voltage controller 33, an H driver 34, an analog/digital converter (A/D) 35, a coding circuit 36 including a video memory, a timing generator (TG) 37 and the like.

The Y driver 31 is connected to each of the scanning electrodes Y (first electrodes) to supply a predetermined driving signal. The X driver 32 is connected to each of the sustaining electrodes X (second electrodes) connected to each other at a common point, and supplies a predetermined driving signal to each of the sustaining electrodes X.

The frequency/voltage controller 33 is connected to the Y driver 31 and the X driver 32 to control frequency and/or voltage of the driving signals applied to the panel. The H driver 34 is connected to each of the data electrodes H (third electrodes), and applies a voltage corresponding to video data to each of the data electrodes H.

The analog/digital converter 35 subjects a video signal SV externally supplied thereto to A/D conversion, and then outputs video data DV of multiple gradation steps. In some cases, the driving unit may receive a digital video signal after A/D conversion directly from an exterior thereof. The coding circuit 36 includes a video memory. The coding circuit 36 codes the video data DV outputted from the A/D 35, and then supplies the result to the H driver 34. The timing generator 37 operates on the basis of a synchronizing signal included in the video signal SV to supply a required timing signal to the other parts of the driving unit.

In terms of functions, the driving unit shown in FIG. 8 includes input means, coding means, timing means, addressing means, and sustaining means. As for correspondence of these functional means with the parts in FIG. 8, the input means is formed by the analog/digital converter 35 as required. The coding means is realized by the coding circuit 36 including the video memory.

The timing means is formed by the timing generator 37. The addressing means is realized by the H driver 34 and the Y driver 31. The sustaining means is realized by the X driver 32 and the Y driver 31. Frequency control means as a characteristic feature of the present invention is realized by the frequency/voltage controller 33. Voltage control means as another characteristic element of the present invention is also realized by the frequency/voltage controller 33.

Operation of the plasma display apparatus will be described in the following. First, the input means (A/D 35) inputs multiple-gradation-step data DV obtained by quantizing a signal (video signal SV) representing an image. The coding means (coding circuit 36) codes one field of the quantized data DV by a predetermined rule to convert into data distributed over a plurality of sub-fields.

The resulting data is given a weight for each of the sub-fields by the predetermined coding rule. As the coding rule, normal binary coding, linear coding, and various other algorithms can be used.

The timing means (TG 37) sequentially outputs a timing signal for each of the sub-fields in synchronism with the coding. The timing signal is supplied to the Y driver 31, the X driver 32, the frequency/voltage controller 33, the H driver 34, the analog/digital converter 35, the coding circuit 36 and the like to synchronize operation of the units in each sub-field.

The addressing means (H driver 34 and Y driver 31) scans scanning lines in each sub-field in response to the timing signal supplied from the TG 37 while writing data assigned to the sub-field via data lines.

Specifically, the Y driver 31 supplies a driving signal to the scanning electrodes Y corresponding to the scanning lines on a dot-sequential basis, while the H driver 34 applies voltage of the data assigned to the sub-field to the data electrodes H corresponding to the data lines. The data is thereby written to the dots D (pixels) provided at intersections of the scanning lines and the data lines.

The sustaining means (X driver 32 and Y driver 31) applies a driving signal to the sustaining electrodes X and the scanning electrodes Y according to the weight of each of the sub-fields to retain the data written in each of the dots by the addressing means according to the weight.

As a characteristic point of the present invention, the sustaining means includes the frequency control means (frequency/voltage controller 33), and at least in one sub-field, the driving signal applied to retain the data has a frequency applied first and a frequency applied thereafter, the frequencies being different from each other. Specifically, the first frequency is controlled to a low level, and the second frequency is controlled to a high level.

The change in the frequency of the driving signal is shown in FIG. 4. In addition, the sustaining means includes the voltage control means (frequency/voltage controller 33), and at least in one sub-field, the driving signal applied to retain the data has a voltage applied first and a voltage applied thereafter, the voltages being different from each other. Specifically, the first voltage is controlled to a high level, and the second voltage is controlled to a low level. This voltage control is shown in the timing chart of FIG. 5.

Figure 9A:
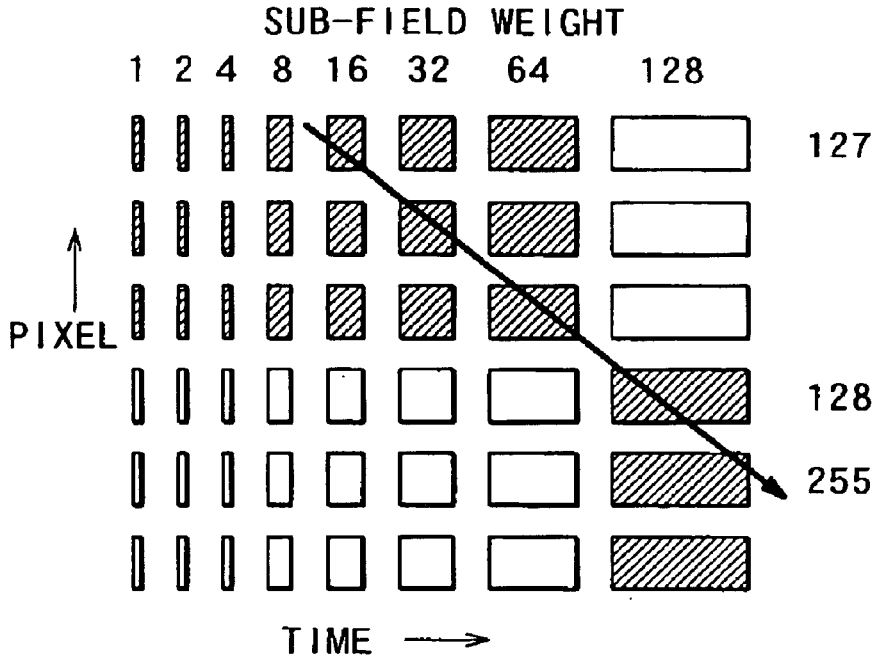
FIG. 9A shows an example of normal binary coding.
Figure 9B:
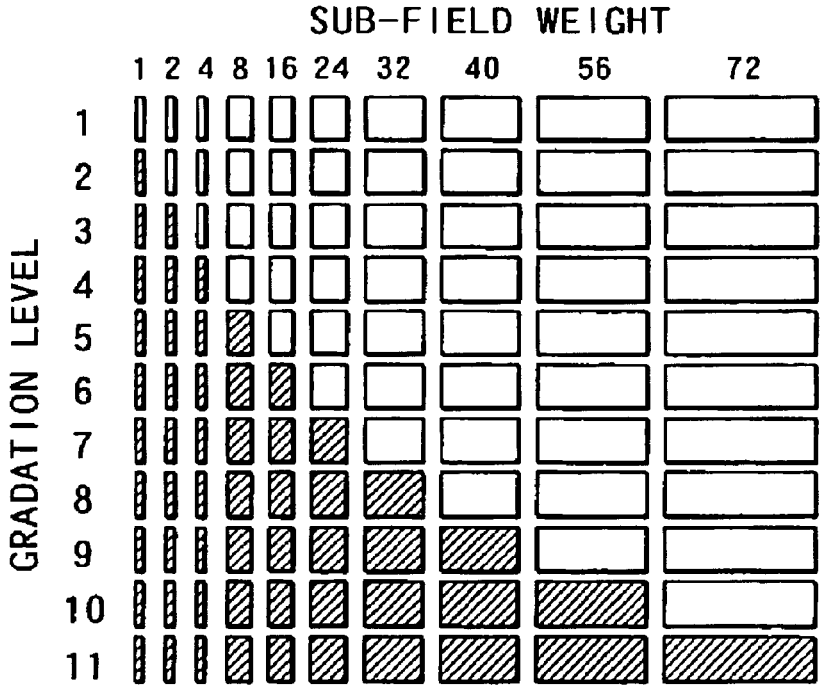
FIG. 9B shows an example of linear coding.

FIGS. 9A and 9B schematically show different examples of the coding performed by the coding circuit 36 (see FIG. 8). FIG. 9A shows normal binary coding, whereas FIG. 9B shows linear coding. In the binary coding of FIG. 9A, a weight for each of the sub-fields is the power of 2, such as 1, 2, 4, 8, 16, 32, 64, or 128. Hence, this coding method is referred to as binary coding.

In binary coding, bits of multiple-gradation-step data represented by a parallel bit formation are in a one-to-one correspondence with the sub-fields. Binary coding therefore has an advantage of requiring a relatively small amount of calculation for the coding. The weight is changed from a minimum value to a maximum value in an order of an LSB to an MSB of the parallel bit formation.

However, binary coding may sometimes cause a moving image false contour. The schematic diagram of FIG. 9A represents pixels (dots) on the axis of ordinates, and has passage of time on the axis of abscissas. Of the six pixels, the upper three have a gradation level of 127, and the lower three have a gradation level of 128. Although a difference in level between the upper three and the lower three is 1, with binary coding weights, sub-field arrangement is changed in an extreme manner between the pixels having the level of 127 and the level of 128, as indicated by hatching.

Thus, when a motion occurs in a direction indicated by a solid line arrow in moving image display, sub-fields corresponding to the level of 127 and a sub-field corresponding to the level of 128 are visually mixed with each other, and thereby perceived as a level of 255, for example. This is the moving image false contour.

FIG. 9B schematically shows linear coding, in which the axis of ordinates denotes gradation level and the axis of abscissas represents weight assigned to the sub-fields. As is clear from the figure, each time the gradation level is sequentially increased from 1, or in increasing order of weight, sub-fields are added one by one.

Hence, non-progressive change in the sub-field allocation in transition from the gradation level of 127 to 128 as in binary coding does not occur in linear coding. The gradation level change and sub-field change are therefore progressive. Non-progressive sub-field leap does not occur, and accordingly linear coding is effective in suppressing moving image false contours. It is to be noted that the present invention is not limited to binary coding and linear coding described above; digital data can be distributed into sub-fields by various coding rules.

[Embodiment as Combination of the Invention and Time Compression Method]

Finally, application of the two-frequency driving method to a time compression method used to suppress so-called moving image false contours in the plasma display apparatus will be described. The time compression method time-compresses each sub-field into a part of one field, and therefore the two-frequency driving according to the present invention becomes all the more important.

That is, the two-frequency driving method according to the present invention can be combined with the time compression method. The two-frequency driving method is effective especially when combined with the time compression method using the equal allocation as shown in FIG. 7. Specifically, by the allocation of equal sub-field periods, a sustaining period can be secured even on the LSB side (B0), and even when the sub-fields are compressed, the two-frequency driving according to the present invention makes stable discharge possible even on the MSB side (B7).

A mechanism of occurrence of a moving image false contour in a plasma display apparatus will be briefly described in the following. In principle, the moving image false contour occurs when the binary coding sub-field method, for example, is used for gradation display, and the moving image false contour results from separation within a field of light emissions having time widths corresponding to weights of their respective bits. When an observer observes a pixel at a certain gradation level and the pixel remains in the eyes of the observer within a period of one field, the observer can perceive a correct brightness signal corresponding to the gradation level data as a result of effect of visual integration.

However, when the eyes move while observing a moving image, and the gradation level of the observed image differs from a gradation level after the movement of the eyes, light emitted in a correct sub-field for forming the gradation level of the observed image does not enter the eyes, and instead light emitted in a wrong sub-field enters the eyes. As a result, the light is perceived as light different from that corresponding to the gradation level data. This phenomenon is referred to as a moving image false contour. Even when the eyes do not move, if the signal is changed within the field and this is reflected in a sub-field signal, a false contour also results.

Figure 10A:
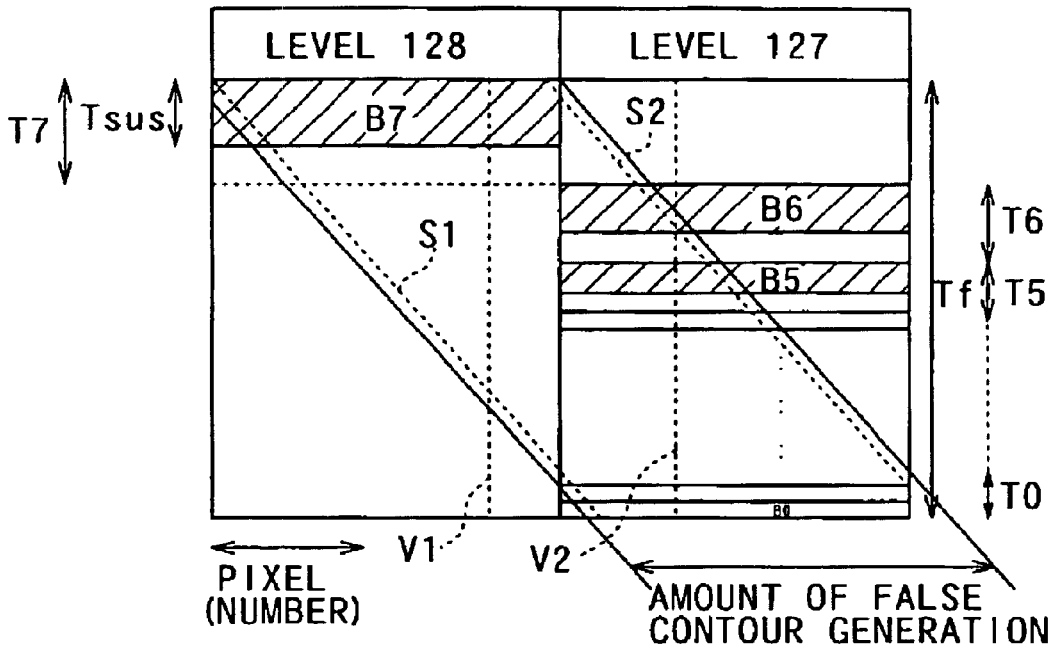
FIG. 10A is a diagram of assistance in explaining perception of false contours at a level of 128 and a level of 127 where there is a great gradation change.

A relation between length of a field and sub-fields and perception of false contours will be described with reference to FIGS. 10A and 10B. As an example, FIG. 10A shows a case of 8-bit gradation level data and a case in which adjacent pixels having a level of 128 and a level of 127 where there is a great gradation change are observed. When observing a vertical broken line V1 shown in the figure, the eyes do not move. There is no movement in observation of the pixel within a period of one field. In other words, there is no change in a horizontal direction.

Hence, the gradation level of 128 given at the vertical broken line V1 can be observed correctly. Similarly, a gradation level of 127 given at a vertical broken line V2 can be observed correctly.

However, when the eyes move within one field, an oblique broken line S1, for example, is observed as B7+B0=a level of 129. Also, another oblique broken line S2 is observed as a level of 255. The correct gradation display level of the broken lines S1 and S2 is 127. The phenomenon of incorrect display of the gradation level as shown in FIG. 10A is referred to as a false contour.

The phenomenon is referred to as a moving image false contour particularly because movement of the eyes prevents observation of a correct gradation level and because movement of an image on the screen causes non-coincidence of gradation level display in the sub-fields. Incidentally, in the case of an amount of false contour generation shown in FIG. 10A, the horizontal direction corresponds to pixels or the number of pixels, or distance, the vertical direction corresponds to time, and the inclination is velocity of movement of the eyes. Alternatively, the inclination is velocity of movement of the image.

Figure 10B:
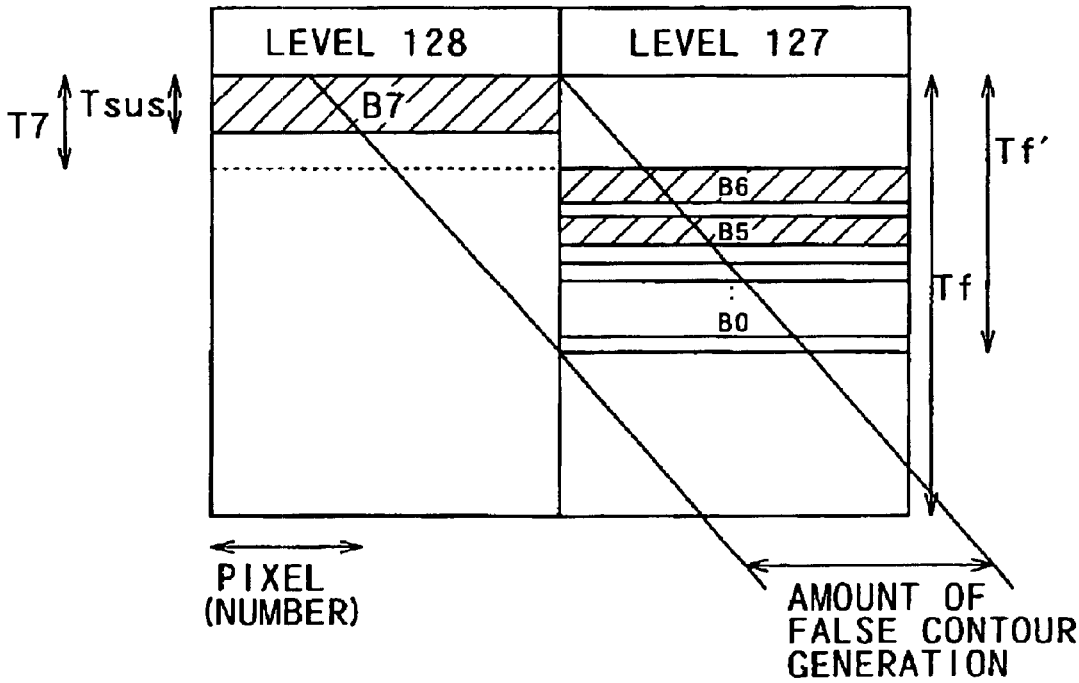
FIG. 10B is a diagram of assistance in explaining a conventional time compression method.

A time compression method as illustrated in FIG. 10B is used as a method for suppressing the moving image false contour described above. By compressing sub-fields in a field as shown in FIG. 10B, the amount of false contour generation is reduced as compared with FIG. 10A.

A time compression ratio is Tf/Tf. However, with a gradation display method using the conventional sub-field method, a sustaining period Tsus contributing to light emission in a sub-field corresponding to a least significant bit B0 is about 15 $\mu$sec. The compression method further shortens time length of the sustaining period Tsus corresponding to the least significant bit, thus making it difficult to control the light emission. Also, an increase in the number of bits for an increased number of gradation levels further shortens the sustaining period Tsus, thus making it difficult to suppress moving image false contours.

Figure 11A:
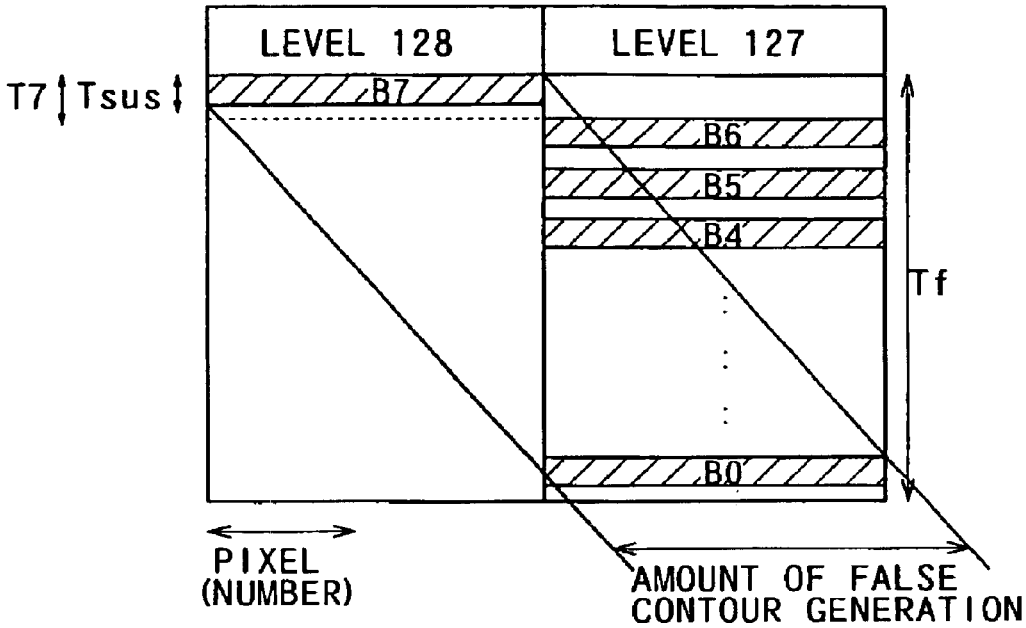
FIG. 11A is a diagram showing an amount of false contour generation when a variable pulse frequency type sub-field method is used.

FIG. 11A is a schematic diagram showing an amount of false contour generation when the variable pulse frequency type sub-field method is used. FIG. 11A is shown for comparison with FIG. 10A illustrating the fixed pulse frequency method. In this example, periods of sub-fields corresponding to bits B7 to B0 are all of equal time width. Unless the time compression method is used, the variable pulse frequency method basically has no advantage in terms of the amount of false contour generation over the fixed pulse frequency method illustrated in FIG. 10A.

Figure 11B:
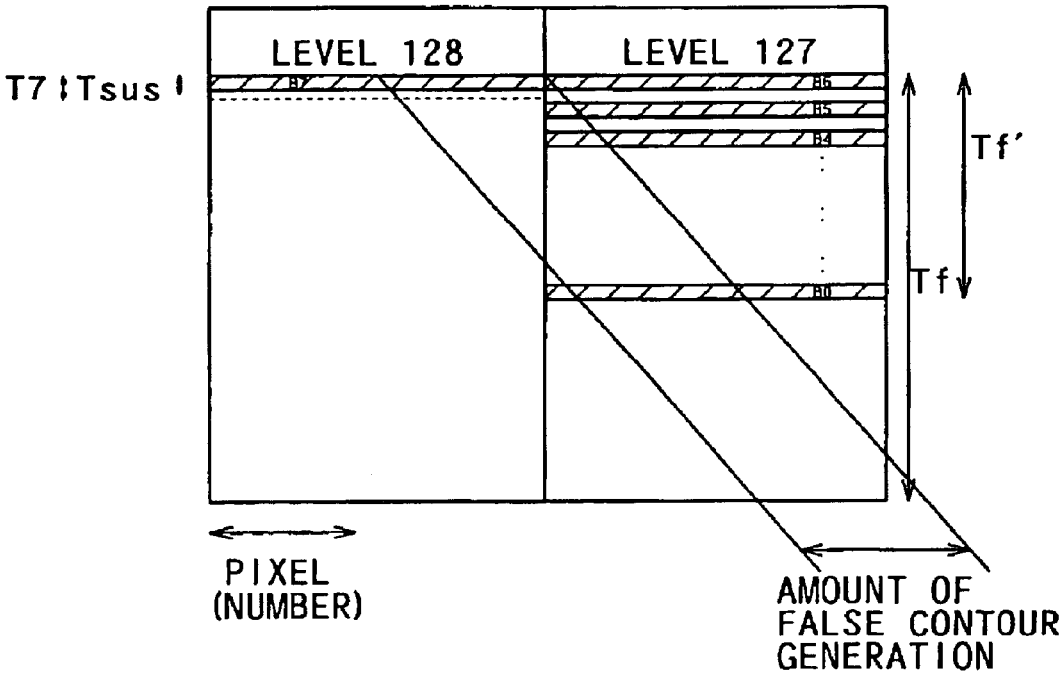
FIG. 11B is a diagram showing a time compression method according to the present invention.

On the other hand, application of the time compression method as shown in FIG. 11B reduces the amount of false contour generation as compared with FIG. 10B. When the sustaining periods Tsus are set equal to a sub-field period (1.615 msec) corresponding to the least significant bit B0 not subjected to the conventional time compression, for example, the compression ratio is 1.615×8/16.7=0.77.

When the compression ratio is raised too much, a ratio of the sustaining periods is reduced, which results in a lower luminous efficiency. In this example, the compression ratio is set at 77%. Hence the amount of false contour generation in this case can be reduced to 77%.

Thus, the time compression method time-compresses each sub-field into a part of one field, and therefore the two-frequency driving according to the present invention becomes all the more important. That is, the two-frequency driving method according to the present invention can be combined with the time compression method. The two-frequency driving method is effective especially when the time compression method is combined with the variable pulse frequency type sub-field method. That is, even when equal sub-field periods are allocated and the sub-fields are compressed, the two-frequency driving according to the present invention makes stable discharge possible even on the MSB side (B7).

As described above, according to the present invention, when multiple-gradation-step display is performed by the plasma display apparatus, the two-frequency driving method is used in which the frequency of the driving signal applied to retain data in a sub-field is first controlled to be low and thereafter controlled to be high, for example. It is thereby possible to stabilize the operation of the plasma display apparatus and increase brightness.

According to the present invention, the two-voltage-level method is used in which the voltage of the driving signal applied to retain data in a sub-field is first controlled to be high and thereafter controlled to be low, for example. It is thereby possible to stabilize the operation of the plasma display apparatus.

What is claimed is:

1. A plasma display apparatus comprising:

a panel including a dischargeable gas sealed between a pair of substrates joined to each other, a first electrode and a second electrode located at one substrate in correspondence with each scanning line, and a third electrode located at the other substrate in correspondence with each data line; and a driving unit for driving the first electrode, the second electrode, and the third electrode, sequentially writing and retaining data at an intersection of each scanning line and each data line;

wherein said driving unit includes input means, coding means, timing means, addressing means, and sustaining means;

said input means inputs multiple-gradation-step data obtained by quantizing a signal;

said coding means codes one field of the quantized data by a predetermined rule to thereby convert into data distributed over a plurality of sub-fields;

said timing means sequentially outputs a timing signal for each of the sub-fields in synchronism with the coding;

said addressing means scans scanning lines in each of the sub-fields in response to the timing signal while writing data assigned to the sub-field via data lines; and said sustaining means includes frequency control means, and applies a driving signal to the first electrode and the second electrode according to a weight of each of the sub-fields, and thereby retains the data written by the addressing means, the driving signal applied to retain the data having, at least in one sub-field, a frequency applied first and a frequency applied thereafter, the frequencies being different from each other.

2. A plasma display apparatus as claimed in claim 1, wherein said sustaining means applies a driving signal having a number of pulses corresponding to a weight of the written data to the first electrode and the second electrode; and said frequency control means adjusts a pulse interval of the driving signal in each of the sub-fields such that the pulse interval is shortened in a sub-field lengthened in a sub-field having a small number of pulses.

3. A driving method of a plasma display apparatus, said plasma display apparatus having a panel including a dischargeable gas sealed between a pair of substrates joined to each other, a first electrode and a second electrode formed on one substrate in correspondence with each scanning line, and a third electrode formed on the other substrate in correspondence with each data line, and said plasma display apparatus driving the first electrode, the second electrode, and the third electrode, sequentially writing and retaining data at an intersection of each scanning line and each data line, and thereby displaying one field of image, wherein said driving method includes an input step, a coding step, a timing step, an addressing step, and a sustaining step;

said input step inputs multiple-gradation-step data obtained by quantizing a signal representing an image;

said coding step codes one field of the quantized data by a predetermined rule to thereby convert into data distributed over a plurality of sub-fields;

said timing step sequentially outputs a timing signal for each of the sub-fields in synchronism with the coding;

said addressing step scans scanning lines in each of the sub-fields in response to the timing signal while writing data assigned to the sub-field via data lines; and said sustaining step includes a frequency control step, applies a driving signal to the first electrode and the second electrode according to a weight of each of the sub-fields, and thereby retains the data written by the addressing step, the driving signal applied to retain the data having, at least in one sub-field, a frequency applied first and a frequency applied thereafter, the frequencies being different from each other.

4. A panel including a dischargeable gas sealed between a pair of substrates joined to each other, a first electrode and a second electrode located at one substrate in correspondence with each scanning line, and a third electrode located at the other substrate in correspondence with each data line; and a driving unit for driving the first electrode, the second electrode, and the third electrode, sequentially writing and retaining data at an intersection of each scanning line and each data line;

wherein said driving unit includes addressing means and sustaining means, and further wherein said sustaining means includes frequency control means, and the sustaining signal is applied at a first and a second frequency, the first and second frequencies being different from each other.

5. A driving method of a plasma display apparatus, said plasma display apparatus having a panel including a dischargeable gas sealed between a pair of substrates joined to each other, a first electrode and a second electrode located at one substrate in correspondence with each scanning line, and a third electrode located at the other substrate in correspondence with each data line, and said plasma display apparatus driving the first electrode, the second electrode, and the third electrode, sequentially writing and retaining data at an intersection of each scanning line and each data line, wherein said driving method includes an addressing step, and a sustaining step;

said sustaining step includes a frequency control step wherein the sustaining signal is applied at a first and a second frequency, the frequencies being different from each other.

* * * * *